US005522704A

United States Patent [19]

Casteel

[11] Patent Number: 5,522,704

[45] Date of Patent: Jun. 4, 1996

[54] TRACK MOUNTED FAN

[76] Inventor: Mallard Casteel, 2321 N. Bosworth, Chicago, Ill. 60614

[21] Appl. No.: 329,868

[22] Filed: Oct. 27, 1994

[51] Int. Cl.[6] ..... F04D 29/64; H01R 25/00

[52] U.S. Cl. ..... 416/246.00; 362/404; 439/121

[58] Field of Search ..... 416/5, 146 R, 416/170 R, 246; 362/282, 285, 287, 404; 248/297.2; 417/361; 439/110, 115, 121, 122

[56] References Cited

U.S. PATENT DOCUMENTS

| | | | |
|---|---|---|---|
| 493,305 | 3/1893 | Sherman . | |
| 1,219,745 | 3/1917 | Keen . | |
| 1,698,328 | 1/1929 | Duffie | 416/246 |
| 2,434,130 | 1/1948 | Turner . | |
| 2,857,095 | 10/1958 | Suarez Grau . | |
| 3,603,918 | 9/1971 | Woertz | 439/115 |
| 3,680,030 | 7/1972 | Johnson | 439/121 |
| 3,973,818 | 8/1976 | Soquenne | 439/115 |
| 4,010,997 | 3/1977 | Bulanchuk | 439/121 |
| 4,655,520 | 4/1987 | Cummings | 439/121 |
| 4,975,071 | 12/1990 | Bedocs et al. | 439/121 |

FOREIGN PATENT DOCUMENTS

| | | | |
|---|---|---|---|
| 1117575 | 5/1956 | France | 416/170 R |
| 92/00458 | 1/1992 | WIPO | 416/246 |

*Primary Examiner*—Edward K. Look
*Assistant Examiner*—James A. Larson
*Attorney, Agent, or Firm*—Patula & Associates

[57] ABSTRACT

A track mounting fixture for an electric fan includes a sliding member adapted to be mounted in a track lighting fixture and constructed to retain an electric fan. Contact members on the sliding member contact conductive strips within a channel on the track member and supply power to the fan at any desired position along the channel length. The fan position may be adjusted easily by sliding the sliding member along the channel and by pivoting the fan about a joint on the sliding member.

12 Claims, 1 Drawing Sheet

TRACK MOUNTED FAN

The present invention relates generally to mounting structures for electric fans and more specifically to a movable fixture for an electric fan with features permitting it to be slidably mounted in a track lighting support fixture.

BACKGROUND OF THE INVENTION

Electric fans are in widespread use to provide air circulation and comfort for building occupants. Room and building climate is constantly influenced by factors such as heating and cooling systems, sunlight, and drafts which affect occupant comfort. Some of these factors vary seasonally as well as throughout the course of the day. Air circulation requirements thus change frequently and fan position must be adjusted in order to maintain maximum occupant comfort.

Typically, a great deal of manual effort is expended during adjustment of fan position since the entire fan and support structure must be manually lifted and moved to the new location. Additionally, cumbersome power cords must be re-routed and/or adjusted. Adjustment in this case requires additional effort and represents a potential safety hazard since the power cord may be oriented in an unsafe position.

There is a need for mounting configurations which are adaptable to suspend the fan from a ceiling or wall in overhead positions. Such configurations provide greater safety than floor-mounted units because the fan and power carrier, i.e., electrical cords, are held out of areas where they might be inadvertently encountered by passers-by. Furthermore, fans which are located at higher elevations in a room provide greater efficiency and comfort. For example, circulating higher temperature air from higher elevations downwards provides for more uniform temperature throughout the room, compensates for drafts, and improves the accuracy and functioning of temperature regulating equipment, i.e., thermostats.

A large amount of effort is typically expended during the installation of fan mounting arrangements on ceilings and walls. Elaborate mounting hardware must be installed to support and provide power to the electric fan. The complexity of such hardware renders movement or re-installation of the fan to a new location prohibitively difficult. It is therefore desirable to incorporate features making the fan mounting arrangement readily adaptable to structures which are already in place and supporting devices other than an electric fan, i.e., track lighting support fixtures thereby eliminating the need to install separate mounting hardware. Furthermore, there is a need for a fan mounting arrangement which permits adjustment of the fan relative to the support fixture so that fan position may be altered without reconfiguration or movement of the support fixture.

There is thus a need for fan mounting structure which is adaptable to ceiling, wall, or floor mounting and permits a high degree of fan mobility while providing safe, simple, and dependable adjustment of fan position. Moreover, a requisite feature of such a mounting arrangement must include ease of installation on a ceiling, wall, or floor, and provide adaptability to mounting hardware which is already in place and supporting devices other than an electric fan, i.e., track lighting support fixtures.

Prior attempts at providing a fan mourning configuration lack provision for ceiling or wall support coupled with ease of adjustment and installation. Furthermore, these attempts fall short of providing a fan mounting arrangement adaptable to existing, already-installed support fixtures for other devices.

U.S. Pat. No. 2,857,095 to Suarez Cirau discloses a support for mounting a fan on a floor or in a window. Inner and outer bale structures which are movable relative to one another provide for various positions of the window mounted fan and act as support arms when the fan is set on the floor. The mourning structure is applicable only to floors or windows and is not adaptable to ceiling locations. Adjustment of the fan position requires reconfiguration or movement of the support structure. No mounting on already-installed support fixtures is disclosed.

Similarly, U.S. Pat. No. 1,219,745 to Keen discloses a ball-joint mounting structure for an electric fan adapted to lamp bases. A conventional screw plug connection is provided to supply power from a lamp base to the fan. One embodiment contemplates a wall or ceiling mounted fixture. The mounting arrangement, however, lacks provision for adjustment of the fan relative to the support fixture.

U.S. Pat. No. 493,305 to Sherman discloses a bed canopy which includes a slidable fixture for a fan. The fan is driven by an elastic band which is routed in a complex manner about the bed and coupled to a motor. The fan mounting fixture is not adaptable to a ceiling or a wall but requires a bed canopy. Adjustment of the fan position requires reconfiguration of the driving band and associated hardware.

The present invention solves the problems, disadvantages, and shortcomings of the prior art by providing adaptability of the fan mounting arrangement to already-installed support fixtures which are in use for other purposes. The solution of the present invention further provides ceiling, wall or floor-oriented mounting arrangements, and safe, simple, and dependable adjustment of the fan position without reconfiguration or movement of the fan mounting support fixture.

BRIEF SUMMARY OF THE INVENTION

It is the principle object of the present invention to provide a means for movably mounting an electric fan.

It is a further object of the present invention to provide a mounting arrangement for an electric fan which is safe, easy to use, and adaptable to support fixtures which have been installed to support devices other than electric fans.

It is yet another object of the present invention to provide a mounting base for an electric fan which base is constructed to be mounted within conventional track lighting fixtures.

It is a further object of the present invention to provide a mounting arrangement for an electric fan which is adapted for use with conventional track lighting supports.

It is still a further object of the present invention to improve conventional track mounting fixtures to provide a more dependable and stable mounting of appliances other than conventional lighting devices.

Briefly, these and other related objectives are realized in accordance with the present invention by means of a base member constructed to be mounted within a track lighting support fixture and having an end adapted to hold an electric fan.

Numerous other advantages and features of and various means for practicing the invention will become apparent from the detailed description of the preferred embodiment of the invention, from the claims, and from the accompanying drawings, in which like numerals are used to designate like parts shown in different figures.

BRIEF DESCRIPTION OF THE DRAWINGS

A complete understanding of the foregoing may be had by reference to the accompanying drawings wherein.

DETAILED DESCRIPTION OF THE PREFERRED EMBODIMENT OF THE PRESENT INVENTION

Figure 1:
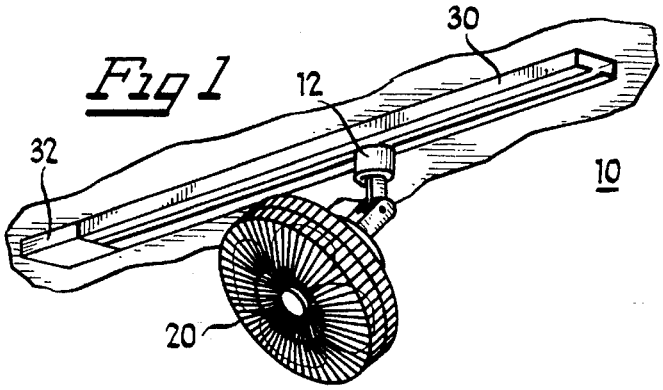
FIG. 1 is a perspective view of a preferred embodiment of the present invention supported on a wall or ceiling.

While the invention is susceptible of embodiment in many different forms, there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

FIGS. 1–6 illustrate a preferred embodiment of the present invention generally designated as 10. A base member 12 is constructed to be mounted for slidable movement inside track lighting support fixture 30. An end portion 14 of the base member 12 is provided with a coupling 16 for holding an electric fan 20.

Base member 12 is connected via a neck portion 17 to a retaining member 18 which is constructed to slidably couple the base member 12 to channel 40 of track lighting support fixture 30. The retaining member 18, neck portion 17, and base member 12 are primarily constructed of a non-conductive material such as polyurethane, polypropylene, or any suitable plastic.

Figure 4:
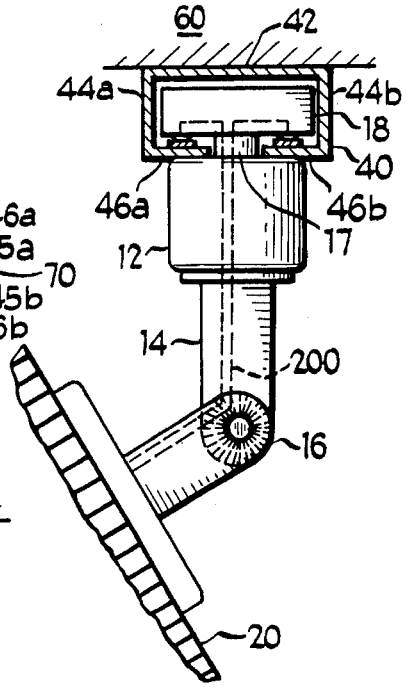
FIG. 4 is a side view of a preferred embodiment of the present invention showing the open end of the track lighting support and swivel fixture of the fan support.

As best seen in FIG. 4, channel 40 is generally C-shaped in cross-section viewed along its longitudinal axis. However, other cross-sectional shapes may be used so long as the retaining member and channel are complementarily-shaped in cross-section. Support fixture 30 is typically mounted on a wall or ceiling but is also adaptable to floor mounting. A power supply 32 which may include a conventional transformer or ballast for supplying appropriate power to the fan unit is shown adjacent the channel member.

As best seen in FIG. 4, C-shaped channel 40 includes a generally planar base plate 42 which abuts the mounting surface 60 on a ceiling, wall, or floor and is attached thereto by any conventional fastening implement, i.e., screws, adhesives, toggle bolts. Lateral portions 44*a* and 44*b* extend at right angles to the base plate toward support portions 46*a* and 46*b*. The support portions 46*a* and 46*b* extend at right angles from respective lateral portions 44*a* and 44*b* inward toward each other and form a slot 70. Retaining member 18 rests via contact members 50*a*, 50*b*, 55*a*, and 55*b*, which will be described below, on the support portions 46*a* and 46*b*. The neck portion 17 is located within slot 70 and partially guides the movement of base member 12.

Conductive strips 45*a* and 45*b* extend longitudinally along the entire length of respective support portions 46*a* and 46*b* and provide a means for conveying power from the power supply 32 to the base member 12 and ultimately to the electric fan 20. Conductive strips 45*a* and 45*b* maintain a voltage therebetween. The channel is preferably constructed of non-conductive material such as plastic, however, the channel may be constructed of metallic material with any known insulation material provided to isolate the conductive strips 45*a*, 45*b*, from the channel support portions 46*a* and 46*b*.

Retaining member 18 is provided with contact members 50*a*, 50*b*, 55*a*, and 55*b* which are mounted thereon to slidably contact conductive strips 45*a* and 45*b*. The contact members are constructed from an electrically conductive material, preferably with a low coefficient of friction. For example, graphite-containing elements may be used for the contact members. Also, rolling ball units may be mounted within the retainer portion for rolling contact with the conductive strips for conducting electric current from the conductive strips. Although two contact members per retainer member sides are illustrated, other embodiments are contemplated including a single contact member for each respective conductive strip or more than two contact members per conductive strip.

The contact members are biased against the conductive strips. Biasing may be accomplished by spring members 100 shown schematically in FIG. 3, each associated with a respective contact member 55 and housed within a recess or housing cavity in the retaining member. Alternatively, biasing of the contact members may be accomplished in whole or in part using weight of the base member, retainer member, and/or fan in the case where the track lighting support fixture 30 is suspended from a ceiling. As yet another alternative, a spring device (not shown) may be located between the retainer member 18 and the base plate 42 to bias the retaining member 18 and the base plate 42 to bias the retaining member 18 against the support portions 46*a* and 46*b* in the case where gravity cannot be relied upon for bias, i.e., where the track lighting support fixture base portion 60 abuts a floor or vertical wall.

Figure 3:
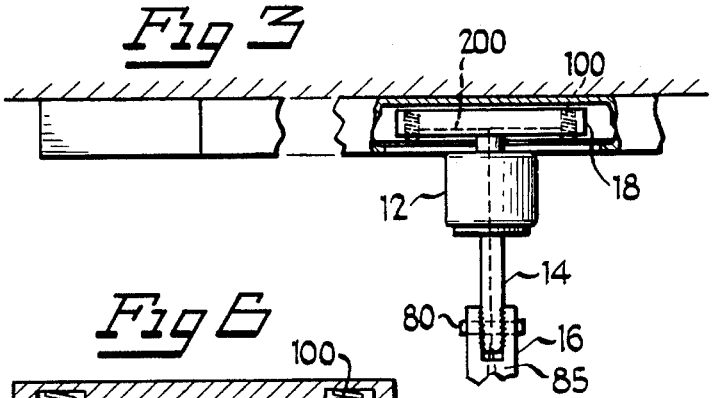
FIG. 3 is a front view of a preferred embodiment of the present invention showing a cutaway of the track support to reveal the fan mounting structure.
Figure 6:
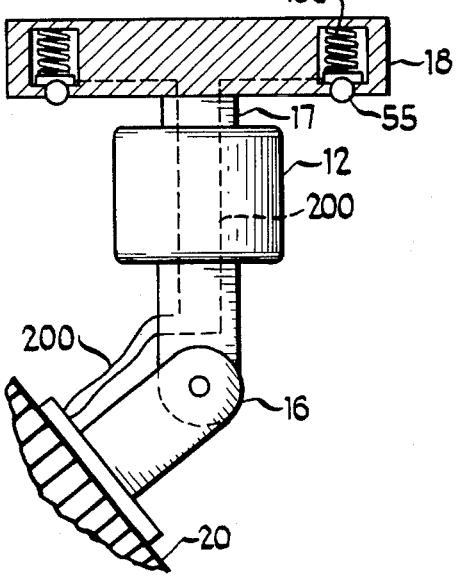
FIG. 6 is a side view of the mounting fixture, which is a preferred embodiment of the present invention, (schematically) showing electrical conductors.

Conductor elements 200, depicted schematically in FIGS. 3, 4, and 6 carry electric current from the contact members through base member 12 to the electric fan 20.

Figure 2:
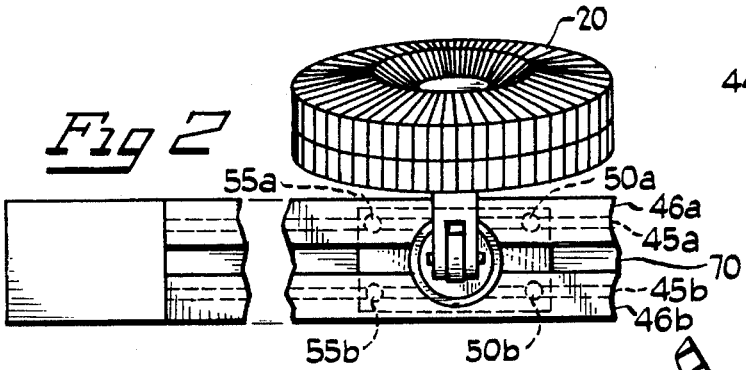
FIG. 2 is another view of a preferred embodiment of the present invention as seen from the bottom of FIG. 1.
Figure 5:
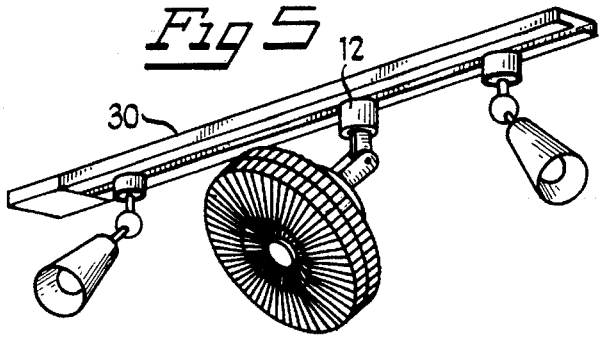
FIG. 5 is a perspective view of a preferred embodiment of the present invention accompanying conventional track-lights on a track.

Base member 12 is provided with a coupling 16 at its end portion 14 opposite the retaining portion 18. Illustrated in FIG. 2, 4, and 5 is a swivel joint comprising a pivot pin 80 and a yoke member 85 which is pivotably fastened to base member end portion 14 pin member 80. Sufficient friction exists between the yoke member 85, pivot pin 80, and end portion 14 so that the end portion 14 and yoke member 85 may be adjusted but will remain in the same position with respect to one another during fan operation. Other types of couplings, such as a ball joint or flexible length conduit may be utilized in place of the swivel joint.

In use, the base member 12 is slidably supported within channel 40 via retaining member 18. Power is supplied to the fan 20 through the conductive strips, contact members, and conductive elements. Base member 12 may be moved to any desired position along the channel 40 without disconnecting power to the fan and without movement of the track lighting support fixture 30.

It is to be understood that the embodiments herein described are merely illustrative of the principles of the present invention. Various modifications may be made by those skilled in the art without departing from the spirit or scope of the claims which follow.

I claim:

1. A track mounted electric fan comprising:

a track member including a channel member and a power supply, said channel member comprising:

a planar base portion;

two lateral portions extending substantially perpendicular to said base portion;

two support portions extending perpendicular to said lateral portions and towards one another;

said base portion, lateral portions, and support portions defining a generally C-shaped cross-section;

said track member further including at least two conductive strips extending longitudinally along said support portions and connected to said power supply;

a sliding member comprising:

a base portion, said base portion having an axis;

a retaining portion connected to said base portion and located inside said channel and having at least two contact members which contact said conductive strips;

means for biasing said contact members, in a direction parallel to said base portion axis, against said conductive strips; and an electric fan connected to said sliding member.

2. The fan of claim 1, wherein said at least two contact members are rolling ball units for rolling contact with said conductive strips.

3. The fan of claim 2, wherein said means for biasing is a spring member.

4. The fan of claim 1, wherein said means for biasing are housed within said retaining portion.

5. A mounting device for mounting an electrical device on an electrical track for adjustably receiving said electrical device, said track being connected to a power supply and defining a generally C-shaped channel including a planar base portion, two lateral portions extending substantially perpendicular to said base portion, two support portions extending perpendicular to said lateral portions and towards one another and at least two conductive strips extending longitudinally along said support portions and connected to said power supply; said mounting device comprising:

a base member for mounting said electrical device thereto;

a retaining member, connected to said base member, and slidably positioned within said C-shaped channel, said retaining member including a plurality of housing cavities formed within said retaining member, a contact member disposed within each of said housing cavities for contacting said conductive strips, and means in each of said housing cavities for biasing said contact member towards said conductive strips; and conductor elements in said retaining member and said base member for providing electrical communication between each contact member and said electrical device.

6. The mounting device of claim 5, wherein said contact member is a rolling ball unit for rolling contact with said conductive strips.

7. The mounting device of claim 6, wherein said means for biasing is a spring member.

8. The mounting device of claim 5, wherein said base member has a longitudinal axis parallel to said two lateral portions, and said means for biasing biases said contact member in a direction parallel to said axis.

9. The mounting device of claim 5, wherein said electrical device is a fan.

10. A mounting device for mounting an electrical fan on a track lighting support fixture, said track lighting support fixture being connected to a power supply and defining a generally C-shaped channel including a planar base portion, two lateral portions extending substantially perpendicular to said base portion, and two support portions extending perpendicular to said lateral portions and towards one another and at least two conductive strips extending longitudinally along said support portions and connected to said power supply; said mounting device comprising:

a base member for pivotably mounting said electrical fan thereto;

a retaining member, connected to said base member by a neck portion, and slidably positioned within said C-shaped channel, said base member, said neck portion, and said retaining member defining a longitudinal axis, said retaining member including a plurality of housing cavities formed within said retaining member, a rolling ball contact member disposed within each of said housing cavities for contacting said conductive strips, and spring means in each of said housing cavities for biasing said contact member in a direction parallel to said axis and towards said conductive strips; and conductor elements in said retaining member, said neck portion, and said base member for providing electrical communication between each contact member and said electrical fan.

11. The mounting device of claim 10, wherein said plurality of housing cavities is two.

12. The mounting device of claim 10, wherein said plurality of housing cavities is four.

* * * * *